US006058556A

United States Patent [19]

Jones

[11] Patent Number: 6,058,556

[45] Date of Patent: May 9, 2000

[54] MOVABLE HEAD BRISTLE BLOCK CLEANER

[75] Inventor: Mark E. Jones, Labelle, Fla.

[73] Assignee: BNS Engineering, Inc., Hialeah, Fla.

[21] Appl. No.: 09/170,434

[22] Filed: Oct. 13, 1998

Related U.S. Application Data

[63] Continuation-in-part of application No. 08/996,419, Dec. 22, 1997, abandoned.

[51] Int. Cl.[7] ..... A47L 5/38

[52] U.S. Cl. ..... 15/302; 15/320; 134/122 R; 198/495

[58] Field of Search ..... 15/302, 320, 308, 15/309.1, 309.2; 134/123, 56 R, 168 R, 167 R, 172, 181, 180, 122 R, 64 R; 239/263, 263.1, 261; 162/275, 277; 198/495

[56] References Cited

U.S. PATENT DOCUMENTS

| | | | |
|---|---|---|---|
| 1,235,027 | 7/1917 | Harrison . | |
| 1,788,364 | 1/1931 | Gies . | |
| 3,252,691 | 5/1966 | Getzin et al. . | |
| 3,420,710 | 1/1969 | Wollman . | |
| 3,606,897 | 9/1971 | Tobin | 134/86 |
| 3,611,472 | 10/1971 | Kayser . | |
| 3,998,388 | 12/1976 | Alagna | 239/187 |
| 4,224,711 | 9/1980 | Gerber . | |
| 4,603,661 | 8/1986 | Nelson | 122/392 |
| 4,605,472 | 8/1986 | Nakamura | 162/277 |
| 4,688,781 | 8/1987 | Blessing | 271/1 |
| 4,753,712 | 6/1988 | Martin et al. | 162/277 |
| 4,777,972 | 10/1988 | Adam . | |
| 5,052,629 | 10/1991 | Belanger et al. . | |
| 5,107,873 | 4/1992 | Clinger | 134/56 R |
| 5,167,720 | 12/1992 | Diamond | 134/25.4 |
| 5,197,160 | 3/1993 | Smith | 15/306.1 |
| 5,361,453 | 11/1994 | Gerber . | |
| 5,411,897 | 5/1995 | Harvey | 437/8 |
| 5,412,836 | 5/1995 | Kuchta | 15/308 |
| 5,579,787 | 12/1996 | Wood | 134/22.1 |
| 5,617,772 | 4/1997 | Hosono | 92/117 A |
| 5,778,671 | 7/1998 | Bloomquist | 60/456 |
| 5,879,515 | 3/1999 | Straub et al. . | |

*Primary Examiner*—Frankie L. Stinson

[57] ABSTRACT

A movable-head cloth-cutter bristle block cleaner for cleaning a conveyor-type bristle bed trained between the rotatable end units of a cloth cutter. The cleaner has a movable head attached to a cable cylinder which is coupled to the frame of the cloth cutter. The head moves substantially the entire width of the bristle bed. In one embodiment, nozzles are placed in several rows on the head and are positioned so that they extend into the bristles of the bristle bed. The movable head is coupled to a supply of compressed air. When the bristle bed moves, high volume, high pressure air is delivered to the head and then shoots out of the nozzles. The jetting action of the gas leaving the nozzles effects removal of debris contained within the bed. Because the cleaning head moves across the entire width of the bristle bed, fewer nozzles are needed to clean the bristle bed. This allows the air pressure coming out of the nozzles to be delivered at a high level. Delivering high pressure jets of air permits cleaning a bristle bed that is already dirtied. Thus, there is no need for continuous operation of the cleaning head.

7 Claims, 7 Drawing Sheets

MOVABLE HEAD BRISTLE BLOCK CLEANER

CROSS-REFERENCE TO RELATED APPLICATIONS

This application is a continuation-in-part of U.S. patent application Ser. No. 08/996,419 filed Dec. 22, 1997 now abandoned.

FIELD OF THE INVENTION

The present invention relates generally to cleaning devices for computerized fabric cutting machines, which are also known as cloth cutters. More particularly, the present invention relates to a movable-head mechanism for cleaning debris from a conveyor-type bristle bed in a cloth cutter.

BACKGROUND OF THE INVENTION

Commercially available, computerized fabric cutting machines include a frame in which an endless loop of bristle blocks (bristles) is mounted. The conveyor-type loop of bristles is trained around driving and support mechanisms such as rollers or toothed wheels. The loop of bristles is rotated and pulls fabric from either a roll of fabric or spreading table mounted on or near the frame. The fabric is moved from the roll or spreading table to a desired location where a cutting head having a knife is positioned.

The cutting head is mounted on a carriage which is coupled to the frame. The carriage, the cutting head, or both are motorized so that the cutting head may move in an X-Y plane. Motion of the cutting head is controlled by a computer or other programmable device so that desired patterns may be cut from the fabric. Once the desired patterns are cut, the loop of bristles is rotated again, the cut pieces of fabric are removed, and the remaining fabric is carried away from the cutting head to a conveyor take-off table.

The bristle bed provides a fabric supporting surface and can withstand repeated penetration by the knife in the cutting head without being damaged. The bristle bed also permits suction from a vacuum to be applied to the fabric to hold it firmly in place while being cut. During the cutting process, the knife in the cutting head cuts through the fabric and dips down between the bristles in order to cut-out individual pieces of fabric. In so doing, loose fibers, threads, small pieces of work material, and other fabric debris collects in the spaces between the bristles. When vacuum grip is used, such debris is pulled down toward the base of the bristles and is firmly lodged in-between them. If left unremoved, this debris hinders the efficient operation of the vacuum, interferes with the knife of the cutting head, and causes premature wear. Thus, in order to maintain vacuum and cutting efficiency the bristle blocks which make up the bed must be periodically cleaned.

The primary method for cleaning such bristles is through a giant vacuum such as that marketed under the trademark SwarfEater and manufactured by Phoenix Engineering Incorporated. The use of this machine necessitates shutting down the fabric cutting machine and manually operating the vacuum to clean the bristle blocks.

Other mechanisms used to clean bristles include the one shown in U.S. Pat. No. 4,224,711. The device shown in this patent includes a mechanism which, in general terms, shakes the bristles clean. A problem with this type of cleaner is that the bristle blocks must be separated from the cutting machine, cleaned, and then reassembled onto the machine after cleaning. This process is highly labor intensive and, therefore, costly.

Another device used to clean bristles is shown in U.S. Pat. No. 5,412,836. This device has a cleaning head which is driven across the bristle block loop and uses vacuum and combing action to clean the bristles. A problem with this device is that it is mechanically complex. Among other assemblies, it requires a vacuum source for the cleaning head and a driving mechanism and guide to move the cleaning head across the bristle blocks. Moreover, the device takes a relatively long time to clean the bristles, as it can clean only a relatively small portion of the loop of bristle blocks at a time. One problem common to all of the described cleaning devices is that the cutting machines with which they are used must be shut down (or taken off line) to accomplish the cleaning.

Accordingly, it would be desirable to have a bristle cleaning device that overcomes the problems associated with presently available devices. More specifically, it would be desirable if the bristle cleaning device could clean the bristles while the cloth cutter was still operating and clean bristle beds that are already dirtied and, therefore, not run continuously.

OBJECT AND SUMMARY OF THE INVENTION

Therefore, it is an object of the present invention to provide a device that can clean debris from a loop of bristle blocks (or bristle bed) in a fabric cutting machine.

It is another object of the present invention to provide a device that can clean a bristle bed without requiring removal of the bristles from the fabric cutting machine.

A further object of the present invention is to provide a device that can clean the entire width of the bristle bed of a fabric cutting machine, yet be compact in size.

A further object of the present invention is to provide a device that can clean the bristle bed of a fabric cutting machine while the cutting machine operates in a production mode.

A further object of the present invention is to provide a device that can clean a bristle bed that is already dirtied with accumulated debris.

A further object of the present invention is to provide a device that does not have to run continuously.

These and other objects are achieved in a movable-head bristle bed cleaner that includes a linear actuator with a support or carriage that is movable between a first position and a second position. The linear actuator is designed to move the carriage across the entire width of a bristle bed in a cloth cutter. A cleaning head is mounted on the carriage. The cleaning head has a coupler for being coupled to a supply of compressed air (more generally pressurized fluid) and a plurality of nozzles. Each nozzle has a tip which delivers a jet of compressed air when the head is coupled to the supply of compressed air. A control mechanism is coupled to the linear actuator and controls the movement of the carriage and, therefore, the cleaning head, between the first and second positions. As the cleaning head moves back and forth between the first and second positions the jets of compressed air from the nozzles remove debris in the bristle bed.

In one embodiment of the present invention, the linear actuator is a rodless cable cylinder with a first end and a second end. The rodless cable cylinder is positioned within the frame of a cloth cutter near one end of the loop of bristle blocks. The rodless cable cylinder has a carriage that is movable between a first and a second end of the cable cylinder. The carriage also supports the cleaning head.

Movement of the rodless cable cylinder and, thus, the cleaning head mounted on it is controlled by a control mechanism. The control mechanism takes the form of a control circuit which receives a control signal from the cutting machine. Input of the control signal to the control circuit is controlled by an input switch. When the control signal is present and the input switch is closed, several components, all of which are electrically coupled in parallel with one another, are activated. Of particular importance are a three-way solenoid valve, a first relay, and two limit switches which work in conjunction with one another to control air flow to the rodless cylinder so that it will cause the carriage to move in a first direction until it contacts one of the limit switches. Upon contacting the first limit switch, a condition is generated that causes the three-way solenoid to direct air flow to the rodless cylinder so that the carriage moves in the opposite direction until it contacts the second limit switch. When the second limit switch is contacted, air flow is reversed again and the cycle of moving the carriage between the contact switches is continued until the control signal is turned off, the input switch is opened, or both.

Thus, the present invention provides a mechanism where a relatively small, compact cleaning head may be used to supply jets of pressurized air to clean the bristle blocks of a fabric cutting machine. Using a relatively small head as compared to a larger head enhances the ability to supply high-pressure cleaning jets of air. Yet, even while using a relatively small head, the present invention provides a mechanism whereby the entire width of the bristle block loop used in a cutting machine may be cleaned.

These are just some of the features and advantages of the present invention. Many others will become apparent by reference to the detailed description of the invention taken in combination with the accompanying drawings.

DETAILED DESCRIPTION

Figure 1:
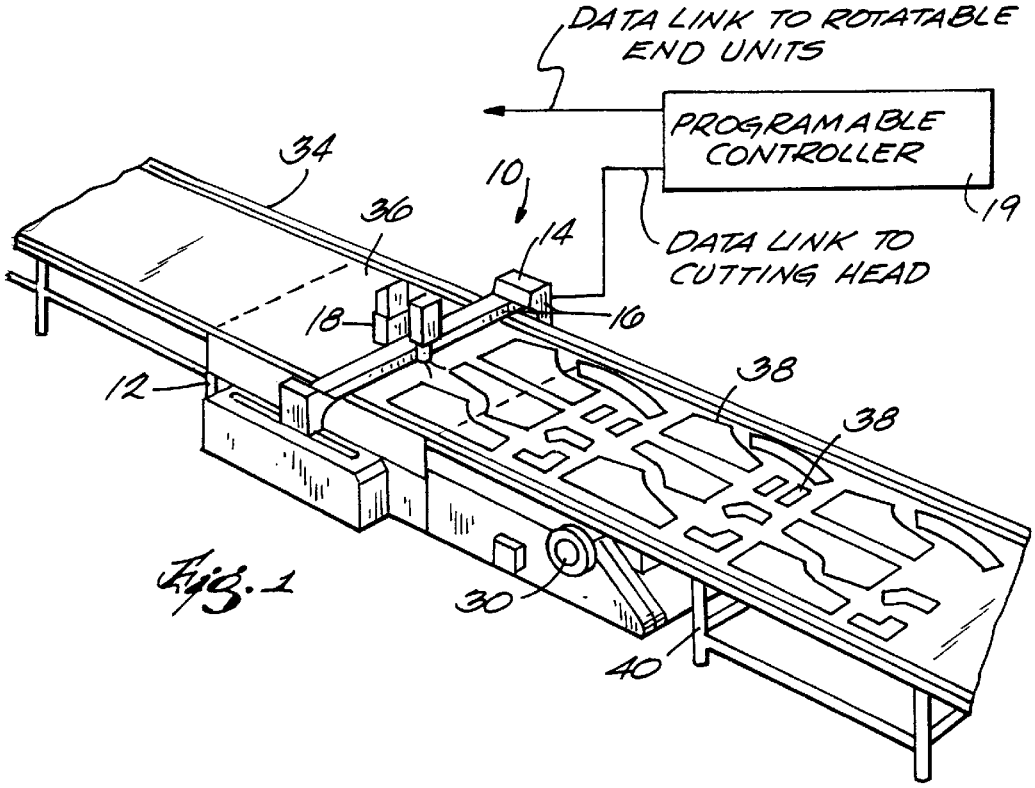
FIG. 1 is a perspective view of a fabric cutting machine in an industrial setting showing a spreading table and fabric take-off table.

A fabric cutting machine 10 is shown in FIG. 1. The machine 10 includes a rectangularly-shaped frame 12. Mounted on the frame 12 is a cutting head carriage 14 which moves in a linear fashion along the longitudinal axis of the frame 12. The cutting head carriage 14 includes a horizontal guide 16 to which a cutting head 18 is mounted. Motion of the cutting head 18 is controlled by a computer or other programmable controller 19.

Positioned within the frame 12 is an endless loop of bristle blocks 20 having a width $W_L$ and which is trained over two spaced-apart rotatable end units 30 and 32. One or both of the end units 30 and 32 may be power driven by a driving mechanism, e.g., the mechanism 33 (FIG. 5), so as to rotate the loop of bristle blocks 20.

Mounted at one end of the frame 12 is a spreading table 34 upon which a desired fabric 36 is laid out in preparation for cutting. The end of the fabric 36 is positioned on the loop of bristle blocks 20 and pulled toward the cutting head carriage 14 and cutting head 18. Once at a desired location on the cutting machine 10, the fabric 36 is cut by the cutting head 18. Cut pieces 38 are removed and the remaining fabric is moved onto a conveyor take-off table 40. The operation and construction of the fabric machine 10 is well understood by those skilled in the art and is explained in numerous prior-art references including U.S. Pat. No. 5,412,836, the disclosure of which is hereby incorporated by reference herein.

Figure 2:
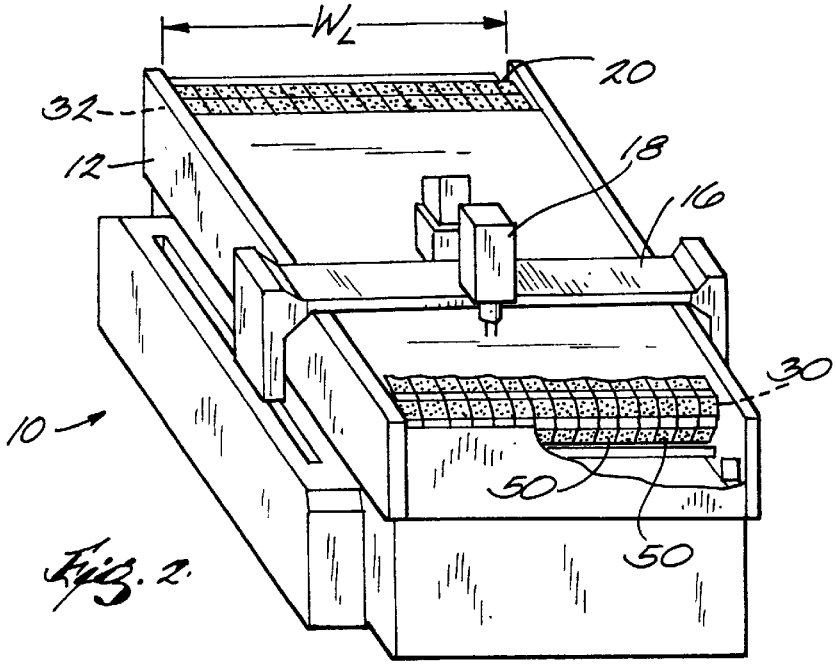
FIG. 2 is a perspective, partial cutaway view of the fabric cutting machine shown in FIG. 1.
Figure 5:
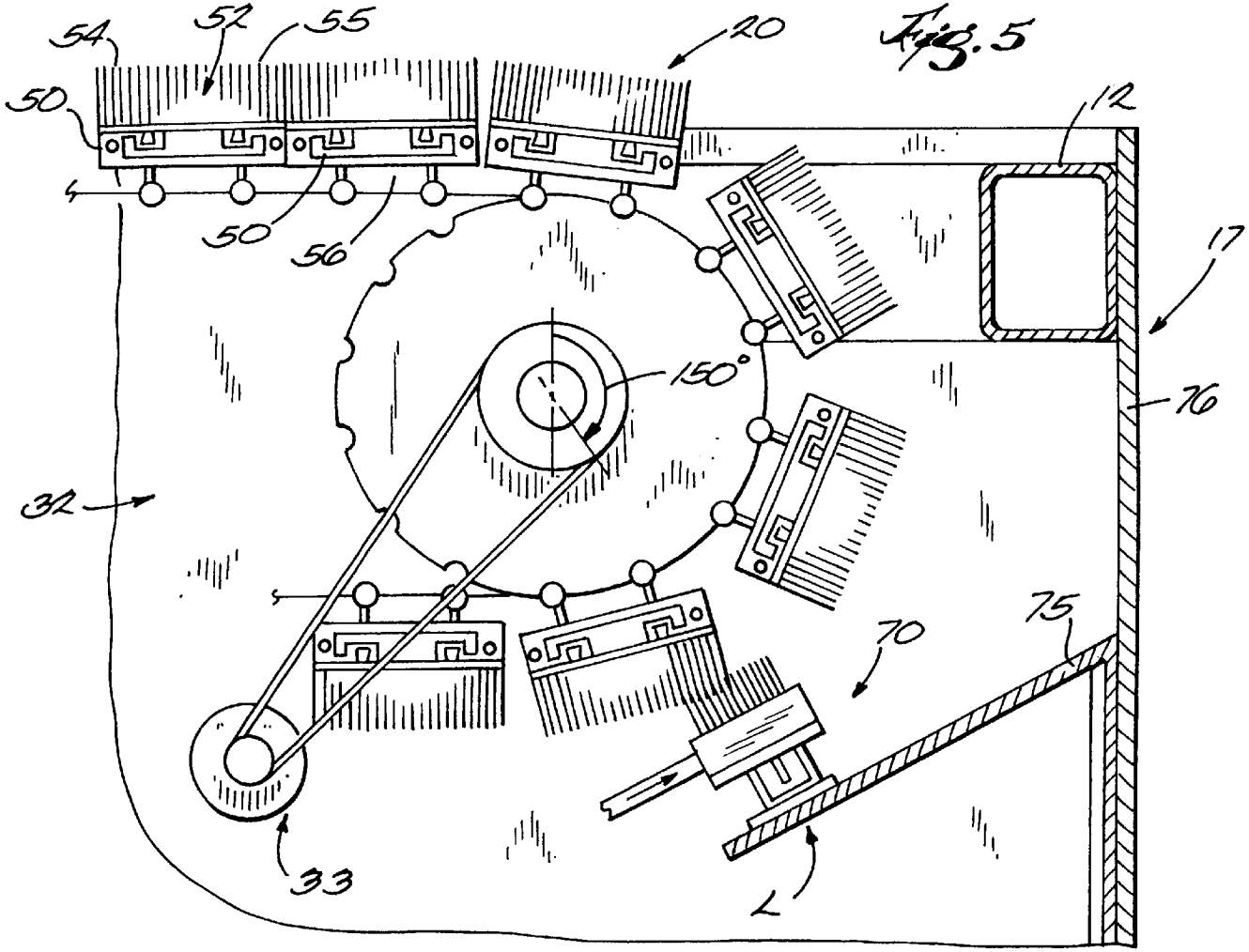
FIG. 5 is a partial, fragmentary side elevational view of the endless loop bristle bed of the fabric cutting machine where the cleaner of the present invention is mounted in the fabric cutting machine.

As best seen by reference to FIG. 2, the loop of bristle blocks 20 (alternatively referred to as a bed of bristles or bristle bed) includes a number of bristles blocks 50 each having a plurality of bristles 52 (FIG. 5). Each block 50 has a contact surface 54 formed by the exposed tips 55 of the bristles 52. The blocks 50 are secured to a chain or other linking mechanism 56 so as to create the loop of bristle blocks 20. The loop 20 rotates around the rotatable end units 30 and 32 such that the contact surface 54 of each block 50 faces upwardly through about half of each rotation of the loop of bristle blocks 20.

The loop 20 rotates in a clockwise fashion. At the end unit 32 the bristle blocks change direction and are turned or rotated through 180° such that the contact surface 54 faces downwardly. A movable-head bristle bed cleaner 70 is positioned at a location L, where the bristle blocks have been rotated through about 150°. The cleaner 70 is positioned at a level below the level of the rotatable end units 30 and 32. The moveable-head bristle bed cleaner 70 is mounted on one or more brackets 75. The brackets 75 are mounted to an end plate 76 which is fixed to the main members of the frame 12.

Figure 3:
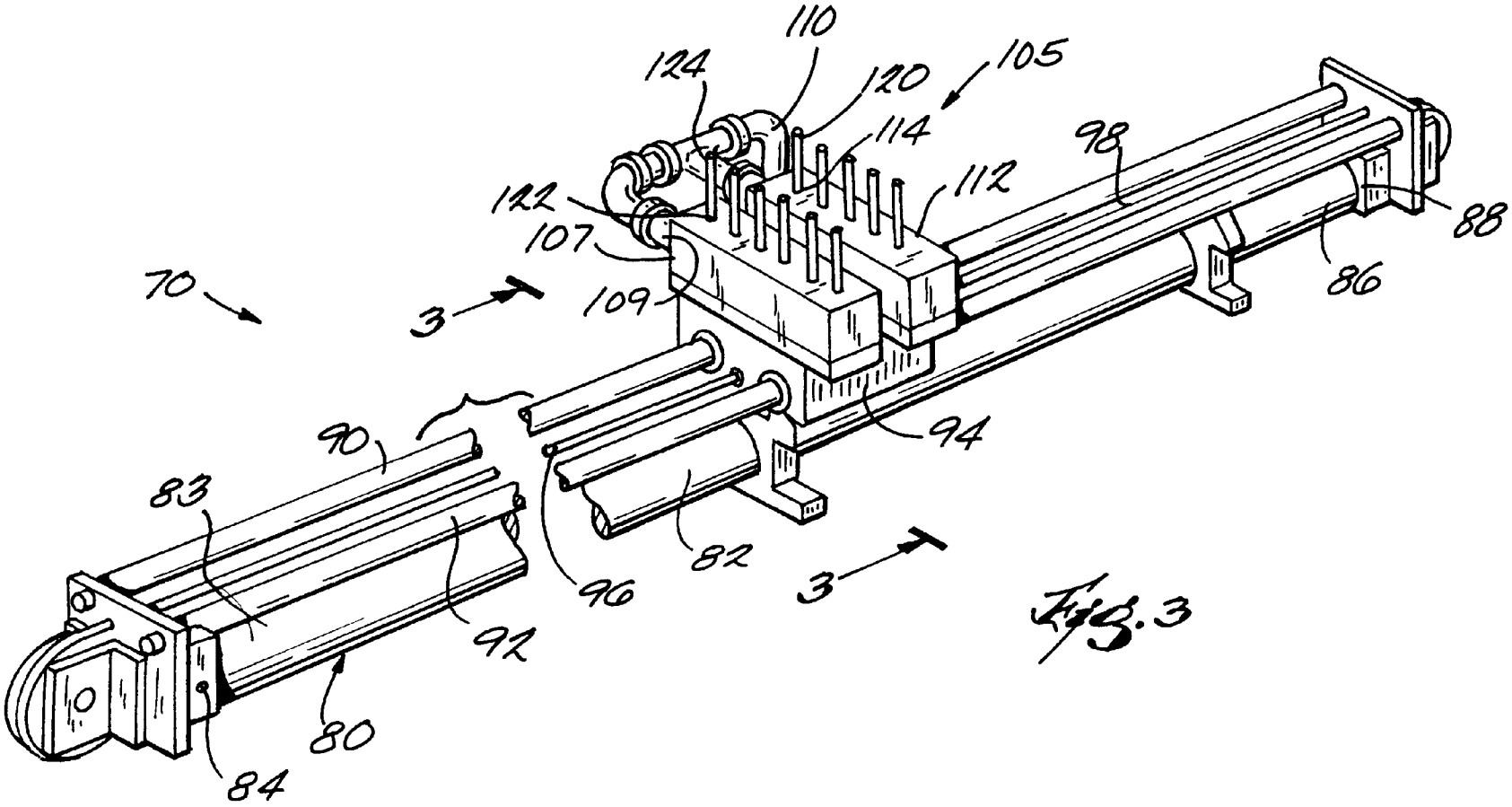
FIG. 3 is a perspective view of a movable-head bristle block cleaner mounted on a cable cylinder.

As best seen by reference to FIG. 3, the cleaner 70 includes a linear actuator which is designed to move a cleaning head (discussed below) of the cleaner 70 across the width $W_L$ of the loop of bristle blocks 20. In the embodiment shown in FIG. 3, the linear actuator is a rodless cable cylinder 80, although linear actuators such as those available from Bimba Manufacturing can be used instead of a rodless cable cylinder. In use, the rodless cable cylinder 80 is mounted on the brackets 75 within the cutting machine 10.

The rodless cable cylinder 80 has a main cylinder 82 which holds a piston (not shown). The main cylinder 82 has a first end 83 with a fluid port 84, which is designed to be coupled to a source of compressed air (not shown). The main cylinder 82 also has a second end 86 with a fluid port 88, also designed to be coupled to the source of compressed air (not shown). The rodless cable cylinder 80 is dimensioned so that it extends across the width $W_L$ of the loop of bristle blocks 20. The rodless cable cylinder 80 has two support rods 90 and 92 on which a carriage 94 rides. The carriage 94 is coupled to two cables 96 and 98. Each of the cables is trained over a pulley and coupled to the piston (not shown) in the main cylinder 82. When there is a pressure differential between the ends of the piston, it will move. Movement of the piston causes the carriage 94 to move. In particular, the carriage 94 moves between the first end 83 and second end 86 of the main cylinder 82 and, as will be discussed in greater detail below, by controlling air flow to the ports 84 and 88, motion of the carriage 94 may be controlled.

Figure 6:
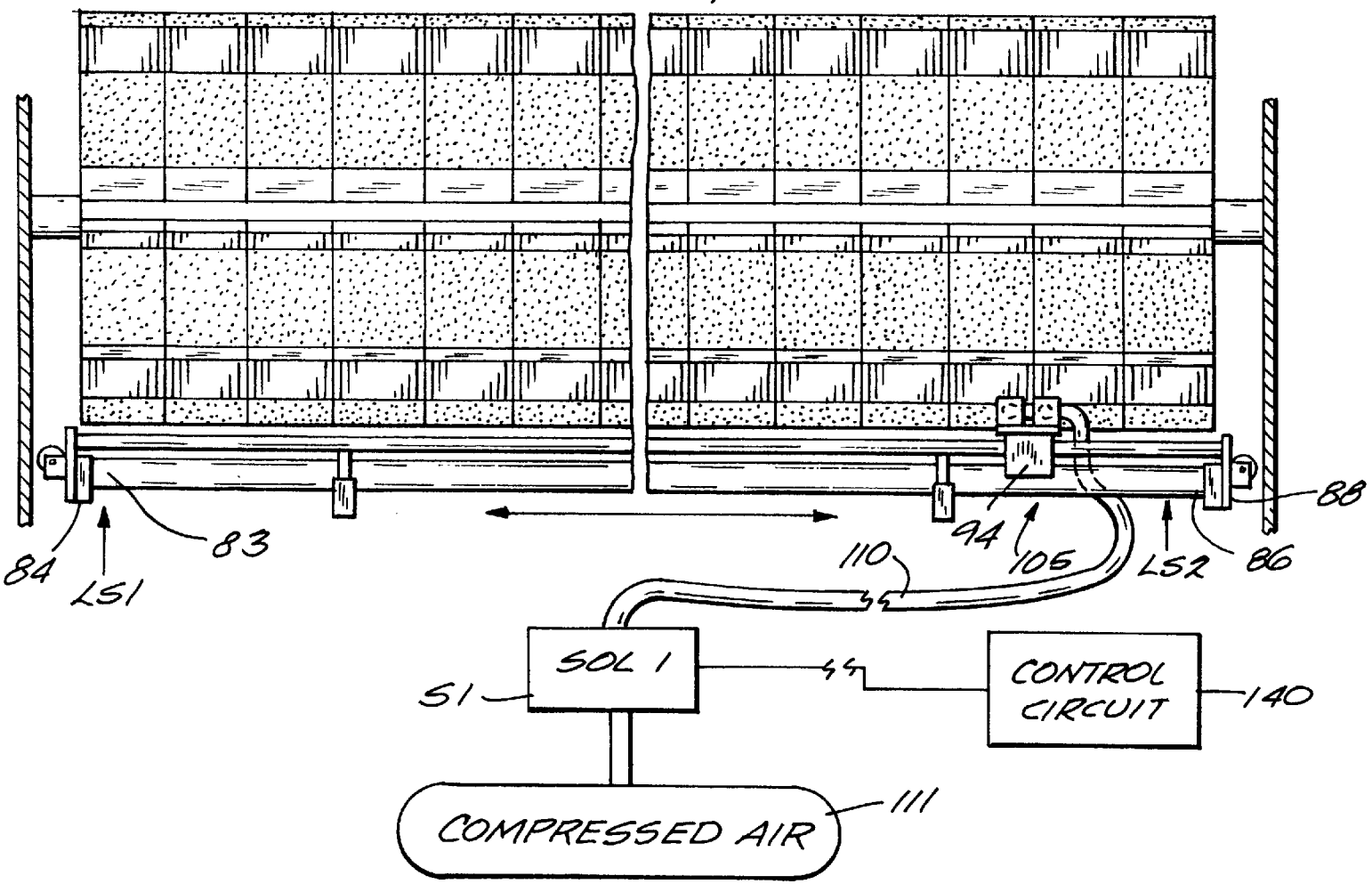
FIG. 6 is a partial, fragmentary end view of the endless loop bristle bed of the fabric cutting machine and the cleaner of the present invention.

A cleaning head 105 is mounted on the carriage 94. The cleaning head 105 has a main chamber 107 with a port 109 which may be coupled via a hose 110 to a second source of compressed air 111 (FIG. 6). The cleaning head 105 also has a top surface 112 with a plurality of apertures 114. As can be seen by reference to FIG. 5, the cleaning head 105 is oriented in such a manner that each of the nozzles 120 is positioned at an angle, in a generally upward direction. A nozzle 120 is mounted in each aperture 114. In one embodiment, the apertures 112 (and therefore the nozzles 120) are aligned on the head 105 in alternating rows of five (5) apertures and four (4) apertures with a total of twenty-three (23) apertures, although other patterns are possible. However, one of the key features of the present invention is that the nozzles are arranged in a relatively small area so that the pressure of the compressed air or other gas supplied through the port 109 to the cleaning head 105 is maintained and high pressure jets of compressed air are delivered out of each nozzle 120. If a larger head is employed, the pressure of the supplied compressed air may drop as it travels through the full volume of the cleaning head.

Referring again to FIG. 3, each nozzle 120 has a base 122, a tip 124, and may be made from stainless steel. About 25 mm to 30 mm of each nozzle 120 extends above the top surface 112 of the cleaning head 105. In one configuration, the cleaner 70 is positioned via the bracket 75 so that about 2 to about 5 mm of each tip 124 of each nozzle 120 is embedded in the bristles 52 of each bristle block 50 as each block passes by the location L. However, the cleaner may be mounted so that the tips 124 of the nozzles 120 are not embedded in the bristles 52 of the bristle blocks 50.

When compressed air flows to the cleaning head 105, it is forced out of each of the nozzles 120 and directed as forceful jets into the bristles 52. The force of the jets dislodges debris trapped in the bristles 52 in an upward direction. Preferably, compressed air at pressure of 120 psi (pounds per square inch) is supplied to the nozzles 90. It has been found that compressed air of a pressure between about 100 to about 120 psi is effective for cleaning purposes and pressures as high as 175 psi may be used for super cleaning action. Using gases at pressures below 100 psi does not effectively clean the bristles. Using pressures significantly above 175 psi may result in damage to bristles or other equipment.

Figure 4:
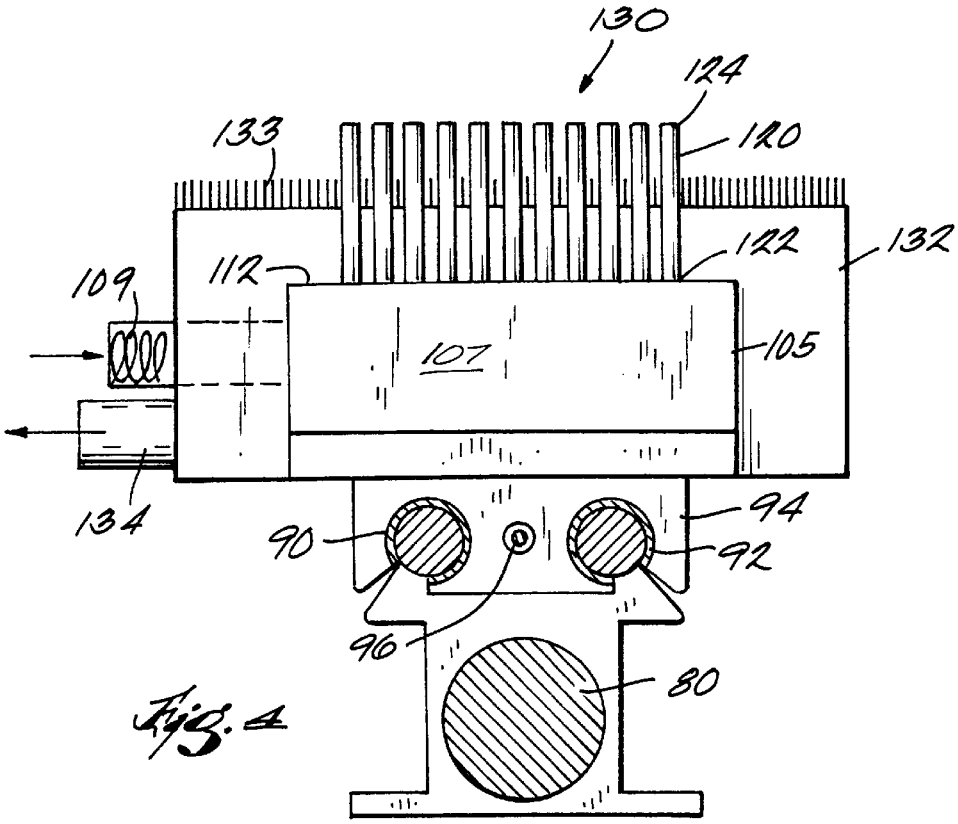
FIG. 4 is a partial, cross sectional view of the cleaner of the present invention taken along the line 3—3 of FIG. 3.
Figure 4A:
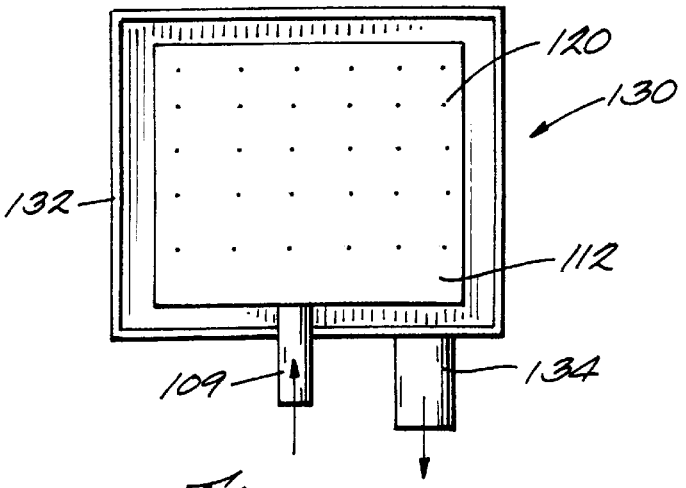
FIG. 4A is a top view of an optional vacuum shroud positioned around the cleaning head of the moveable-head bristle block cleaner shown in FIG. 4.

The freed debris may be allowed to fall by gravity to collect in the bottom of the machine 10. Once collected, the debris may be periodically picked up (e.g., once a week) by various means including industrial vacuums. Alternatively, a vacuum removal system 130 may be connected to the cleaning apparatus 70 (FIG. 4). The vacuum removal system 130 has a shroud 132 with a horse-hair type trim 133 around its peripheral edge. The shroud 132 is dimensioned to fit around and partially encase the cleaning head 105. Specifically, the shroud 132 catches debris as it falls from the bristles 52 by vacuum action. Shroud 132 is connected to a vacuum line 134 which may be coupled to a vacuum source (not shown). As will be discussed below, the vacuum source may be energized when a cleaning cycle begins.

Figure 7:
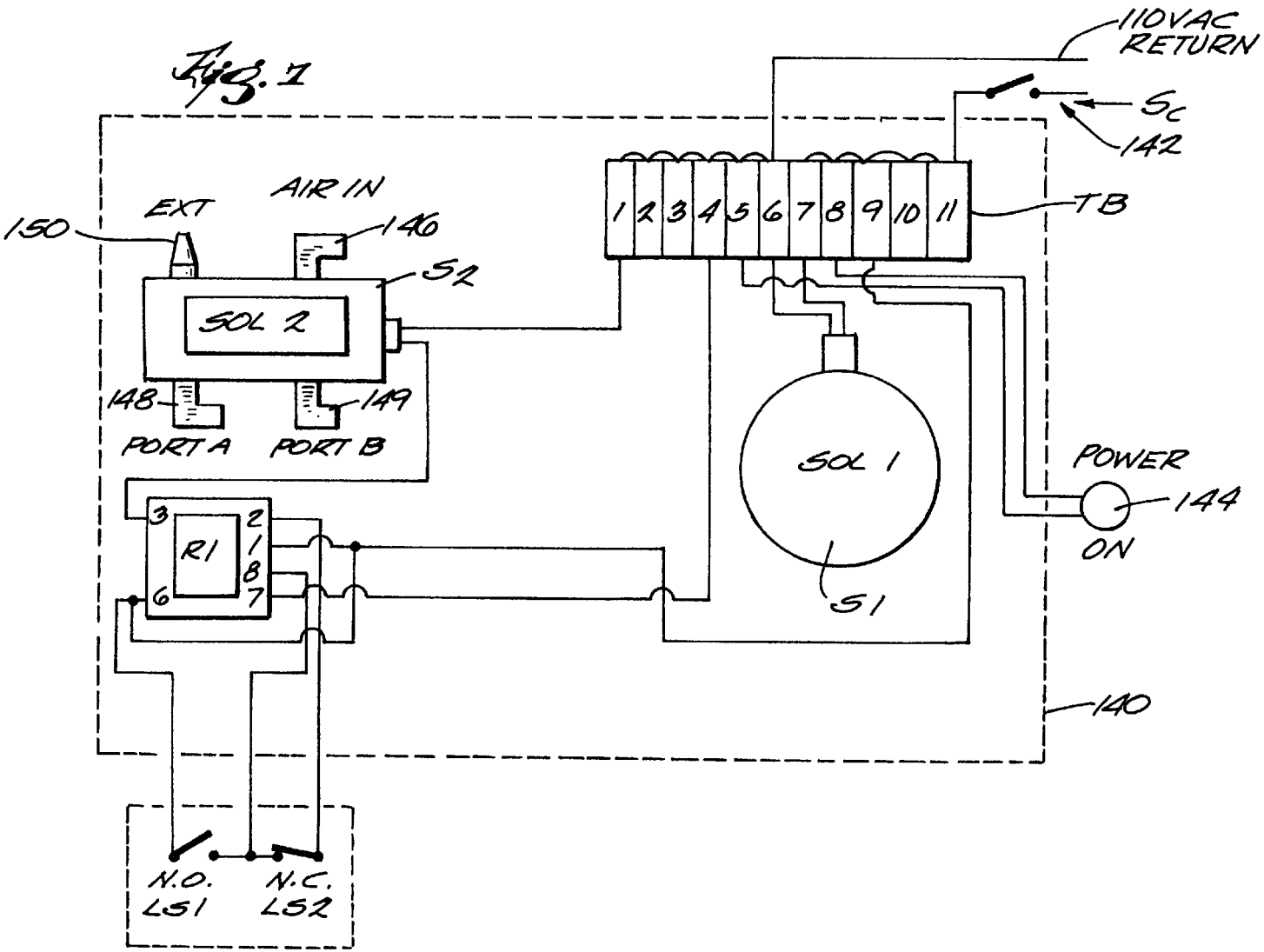
FIG. 7 is a diagram of the control circuitry used in the present invention.
Figure 8:
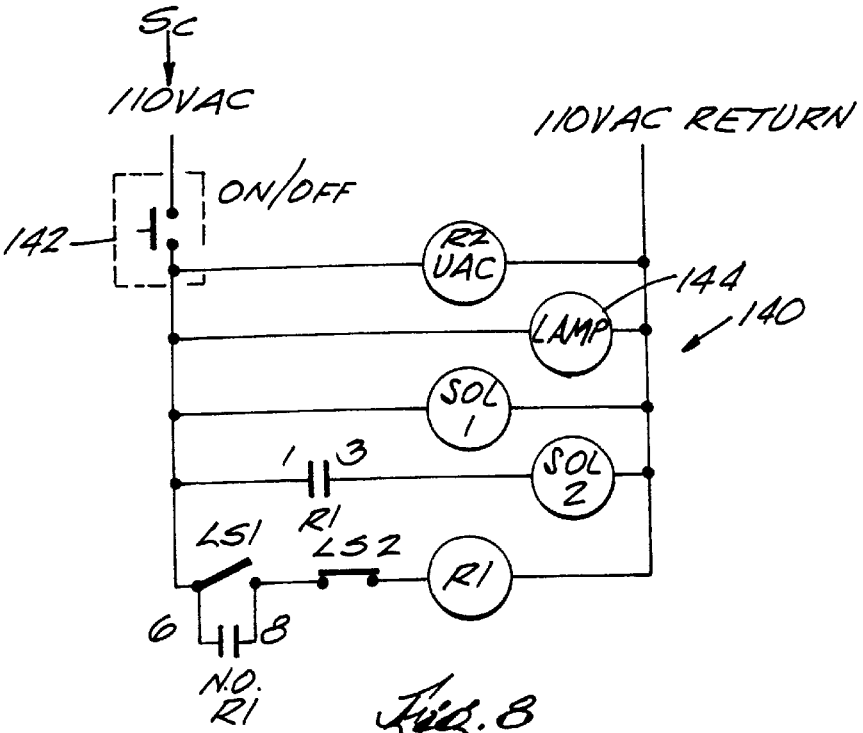
FIG. 8 is another diagram of the control circuitry used in the present invention.
Figure 8A:
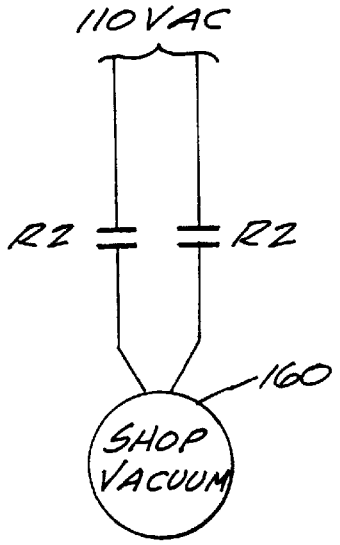
FIG. 8A is a diagram of the circuitry used to control the vacuum system coupled to the optional vacuum shroud shown in FIG. 4A.

The flow of compressed air to the rodless cable cylinder 80 and movement of the cleaning head 105 between the ends 83 and 86 of the main cylinder 82 is controlled by a control circuit 140 which is shown in FIGS. 7 and 8. The control circuit 140 receives a control signal $S_C$ from the cutting machine 10. The control signal $S_C$ is generated as a result of the programmable controller 19 outputting a command signal to the cutting machine telling it to activate the end units 30 and 32. When activated, the end units 30 and 32 cause the loop of bristle blocks 20 to rotate. Input of the control signal $S_C$ to the control signal 140 may be turned on and off by an input switch 142. The input switch 142 is specifically designed to be manually controlled, but could be replaced by a switch controlled by a programmable controller which could be the programmable controller 19.

Assuming the control signal $S_C$ has been sent to the control circuit 140 and that the input switch 142 has been closed, the control signal $S_C$ is delivered to a terminal bar TB. Each of the devices in the control circuit 140 are coupled to the terminal bar TB, and as best seen by reference to FIG. 8, the devices in the control circuit 140 are electrically coupled in parallel to one another. A power-on lamp 144 is coupled to the terminal bar TB and provides a visual indicator to inform an operator when the circuit 140 has be energized. A first solenoid $S_1$ is coupled to the terminal board TB and controls the flow of compressed air from the second source of compressed air 111 to the port 109 of the cleaning head 105. Thus, when the control signal $S_C$ has been generated by the cutting machine 10 and the input switch 142 is closed, compressed air is supplied to the cleaning head 105. Another source of compressed air (not shown) is coupled to a second solenoid $S_2$. The second solenoid $S_2$ is a three-way air valve. Air from this other source of compressed air is input to an inlet 146 and directed out of one of two outlets 148 and 149. If air flow is directed out of outlet 148, the other outlet 149 is coupled to an exhaust 150. Similarly, if air flow is directed out of the outlet 149, the outlet 148 is coupled to the exhaust 150.

The outlet 148 is coupled through a supply hose (not shown) to the fluid port 84 and the outlet 149 is coupled through another supply hose (also not shown) to the fluid port 88. In this manner, air is supplied to one of the two sides of the piston (not shown) in the main cylinder 82. Thus, the direction of movement of the piston in the main cylinder may be controlled by changing the outlet (148 or 149) through which air flows from the second solenoid $S_2$.

The second solenoid $S_2$ is coupled in series with normally open contacts 1 and 3 of a first relay $R_1$. Thus, the second solenoid $S_2$ is turned on and off (or energized and de-energized) by the relay $R_1$. Whether the relay $R_1$ is turned on or off depends on the status of two limit switches LS1 and LS2. The limit switch LS1 is positioned near the first end 83 of the main cylinder 82 and the limit switch LS2 is positioned near the second end 86 of the main cylinder 82. (See FIG. 6). The first solenoid $S_1$ is configured so that air is first supplied to the outlet 148 causing the cleaning head 105 to move to the left toward the limit switch LS1. When the limit switch LS1 is contacted by the cleaning head 105, it closes. When limit switch LS1 closes, the first relay $R_1$ is energized, thereby closing its contacts 1,3 and 6,8. When the contacts 1,3 and 6,8 are closed, the second solenoid $S_2$ changes state, causing the valve inside it to direct air out of the port 149 and coupling the port 148 to the exhaust 150. The redirection of air flow causes the carriage 94 and, thus, the cleaning head 105 to move in the opposite direction toward the end 86.

Because limit switch LS1 is a normally open switch, it is designed to open as soon a contact with it is lost. Thus, the limit switch LS1 is designed to open as soon as the cleaning head 105 moves away from it. However, if this was allowed to occur, the cleaning head 105 would stop moving, because the first relay $R_1$, and, thus, the second solenoid $S_2$, would not be energized. To maintain the current flow, a parallel path around the limit switch LS1 is provided through the contacts 6 and 8 of the first relay $R_1$ (see FIG. 8).

When the cleaning head reaches the second end 86 of the main cylinder 82, it contacts the limit switch LS2 which opens on contact. This action de-energizes the first relay $R_1$ and resets the second solenoid $S_2$. Air flow from the second solenoid $S_2$ is reversed and the cleaning head 105 will move back across the loop of bristle blocks 20 in the opposite direction until the cleaning head 105 contacts the limit switch LS1, which will close upon contact causing the cycle to repeat itself The cycle will keep repeating until the control signal $S_C$ is shut off, the input switch 142 is opened, or both.

As noted above, the cleaner 70 may include an optional vacuum removal system 130. The control circuit 140 is designed to accommodate the use of the vacuum removal system 130. Control of a vacuum generator 160 (such as a Shop•Vac vacuum) is provided by a relay $R_2$ coupled in parallel with the other components of the control circuit 140. Thus, when the control circuit 140 is energized, the vacuum generator 160 is energized and provides a vacuum through the vacuum line 134 to the shroud 132.

It should be understood that the functions carried out by the rodless cable cylinder 80 and control circuit 140 could be carried out by other devices. In particular, the rodless cable cylinder 80 could be replaced by other linear actuators, including other pneumatically controlled actuators and that such actuators could be designed to move the cleaning head 105 back and forth across the width $W_L$ of the loop 20 using a control circuit similar to the control circuit 140 and even devices such as PLCs and programmable computers, although the specific designs described herein appear to have cost and maintenance advantages over more complex designs.

Thus, while the present invention has been described in what are believed to be the most preferred forms, it is to be understood that the invention is not confined to the particular construction and arrangement of the components herein illustrated and described, but embraces such modified forms thereof as come within the scope of the appended claims.

I claim:

1. A cloth cutting machine comprising:

a frame, a bristle bed, and a support coupled to the frame;

a cloth cutter coupled to the frame;

a linear actuator mounted on the support so that the bristle bed is positioned above the linear actuator;

a carriage coupled to the linear actuator and movable between a first position and a second position;

a cleaning head mounted on the carriage and having a plurality of nozzles and an inlet for being coupled to a source of pressurized fluid;

a control mechanism coupled to the linear actuator and the source of pressurized fluid and for controlling motion of the carriage between the first position and the second position and the flow of pressurized fluid from the source of pressurized fluid to the cleaning head;

wherein, each nozzle in the cleaning head delivers a jet of pressurized fluid to the bristle bed when the cleaning head receives pressurized fluid from the source of pressurized fluid, and the cleaning head is operable to clean debris from the bristle bed while the cloth cutting machine is in operation.

2. A cloth cutting machine as in claim 1, wherein the linear actuator is a rodless cable cylinder having a first end and a second end.

3. A cloth cutting machine as in claim 2, wherein the control mechanism includes a control circuit having a first solenoid, a second solenoid, a first relay, a first limit switch, and a second limit switch.

4. A cloth cutting machine as in claim 3, wherein the first solenoid is coupled to the cleaning head and controls the flow of pressurized fluid to it, and second solenoid is a three-way valve.

5. A cloth cutting machine as in claim 4, wherein the second solenoid controls a flow of pressurized fluid to the rodless cable cylinder.

6. A bristle bed cleaner as in claim 1, wherein a vacuum removal system is placed around the cleaning head.

7. In a cloth cutting machine having a frame, a bristle bed positioned within the frame, and a cloth cutter coupled to the frame, the improvement comprising an actuator coupled to the frame so that the bristle bed is positioned above the actuator;

a cleaning head coupled to the actuator and movable between a first position and a second position, the cleaning head having a plurality of nozzles and an inlet for being coupled to a source of pressurized fluid;

a control mechanism coupled to the linear actuator and the source of pressurized fluid and for controlling motion of the cleaning head between the first position and the second position and the flow of pressurized fluid from the source of pressurized fluid to the cleaning head;

wherein, each nozzle in the cleaning head delivers a jet of pressurized fluid to the bristle bed when the cleaning head receives pressurized fluid from the source of pressurized fluid and the cleaning head is operable to clean debris from the bristle bed while the cloth cutting machine is in operation.

* * * * *